United States Patent [19]

Maya

[11] Patent Number: 4,527,086

[45] Date of Patent: Jul. 2, 1985

[54] ARC DISCHARGE DEVICE WITH IMPROVED ISOTOPIC MIXTURE OF MERCURY

[75] Inventor: Jakob Maya, Brookline, Mass.

[73] Assignee: GTE Products Corporation, Stamford, Conn.

[21] Appl. No.: 528,717

[22] Filed: Sep. 2, 1983

[51] Int. Cl.[3] ..... H01J 61/42; H01J 61/20

[52] U.S. Cl. ..... 313/485; 313/639

[58] Field of Search ..... 313/484, 485, 639

[56] References Cited

U.S. PATENT DOCUMENTS 4,379,252 4/1983 Work et al. ..... 313/639 X

*Primary Examiner*—David K. Moore

*Assistant Examiner*—K. Wieder

*Attorney, Agent, or Firm*—William H. McNeill; Carlo S. Bessone

[57] ABSTRACT

In a mercury-containing arc discharge device for converting electrical energy into resonance energy, the isotopic distribution of the mercury in the device is altered from that of natural mercury so as to reduce imprisonment time of resonance radiation and thereby increase the efficiency of conversion of electrical energy into resonance radiation. The $^{196}Hg$ isotope content of the mercury is greater than that in natural mercury and equal to or less than 1% enrichment of $^{196}Hg$ in combination with removal of a portion of the heavy isotopes of $^{200}Hg$ and above.

9 Claims, 1 Drawing Figure

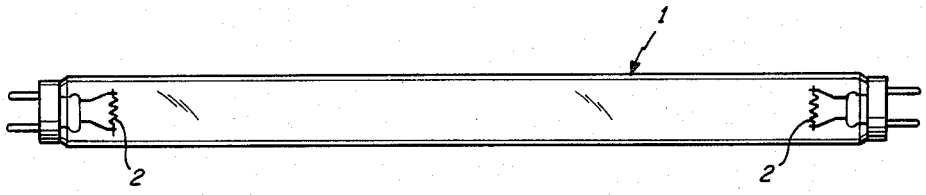
1
2
2

ARC DISCHARGE DEVICE WITH IMPROVED ISOTOPIC MIXTURE OF MERCURY

BACKGROUND OF THE INVENTION

The present invention relates in general to a mercury-containing arc discharge device for converting electrical energy into resonance radiation. More particularly, the present invention is concerned with an improved isotopic mixture of mercury for providing improved efficiency of the device (fluorescent lamp).

It has been known for some time that the resonance trapping time of mercury resonance radiation is an important factor in the efficiency of a fluorescent lamp. The lower the resonance trapping time the higher the lamp efficiency. In this regard see U.S. Pat. No. 4,379,252 to Work, et al., which demonstrates the enrichment of a natural isotopic mixture of mercury by the $^{196}$Hg isotope from a natural abundance of 0.146% to about 3–5%. This has the effect of increasing the efficiency of the fluorescent lamp by about 3%.

Assuming an isotopic distribution of a naturally-occuring mercury with the $^{196}$Hg isotope at about 0.146% and assuming that one desires to increase the efficiency to on the order of 3% this thus means that 20 fold enrichment of the rare $^{196}$Hg isotope. This in turn implies the processing of a large amount of mercury which adds considerably to the cost in attaining this improved efficiency.

It is, therefore, an object of the invention to obviate the disadvantages of the prior art.

Another object of the present invention is to provide an improved isotopic mixture of mercury for mercury-containing arc discharge devices.

Another object of the present invention is to provide an improved isotopic mixture as in accordance with the preceding object and which makes it possible to provide a less expensive mixture of mercury.

A further object of the present invention is to provide an improved isotopic mixture of mercury for arc discharge devices, such as fluorescent lamps, that results in considerable reduction in resonance trapping time, increases lamp efficiency, and yet requires a substantially smaller amount of mercury processing. Because the major cost of altering the natural isotopic composition, via various enrichment schemes, appears to be the cost of handling and processing large amounts of natural mercury, the present invention inevitably results in lower cost of enrichment.

Still another object of the present invention is therefore to provide an improvement in efficiency of a fluorescent lamp which is attained more inexpensively in comparison to the previous technique of adding on the order of 3–5% of $^{196}$Hg isotope.

DISCLOSURE OF THE INVENTION

These objects are achieved, in one aspect of the invention, by the provision of an improved isotope mixture of mercury for use in an arc discharge device and which results in considerable reduction in resonance trapping time; therefore increasing lamp efficiency. Moreover, the increase in efficiency is attained with a lesser amount of mercury processing with a lower attendant cost of enrichment. The improved efficiency is brought about by providing the $^{196}$Hg isotope content of the mercury in a greater percentage than that in natural mercury, preferably in an amount on the order of 1% or less in combination with the removal of some portion of the heavy isotopes of mercury which include isotopes of $^{200}$Hg and above. Thus, the heavy mercury isotopes have a content less than that in natural mercury in accordance with the teachings of this invention. In one example the mercury is enriched with 1% $^{196}$Hg and $\frac{1}{2}$ of isotopes $^{200}$Hg, $^{201}$Hg and $^{202}$Hg along with $\frac{3}{4}$ of isotope $^{204}$Hg are removed. In another example, mercury is enriched with 0.5% $^{196}$Hg and $\frac{1}{2}$ of the isotopes $^{200}$Hg, $^{201}$Hg and $^{202}$Hg along with $\frac{3}{4}$ of isotope $^{204}$Hg are removed. Thus, in both examples the heavy isotopes of mercury have a content less than that in natural mercury.

BRIEF DESCRIPTION OF THE DRAWING

The single FIGURE is a diagrammatic representation of a mercury containing arc discharge device which can employ the invention.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

There is now defined herein a new and improved isotopic mixture of mercury for improving the efficiency of a fluorescent lamp. The efficiency of the fluorescent lamp and of any mercury-containing arc discharge device is improved in accordance with the invention by altering the content of the mercury in the device so as to provide a reduction in resonance trapping time.

The drawing shows a mercury-containing arc discharge device which is shown schematically as comprising a sealed envelope 1 having electrodes 2 at each end thereof. The envelope 1 may be of a length of four feet. The envelope contains mercury and an inert gas such as argon.

In accordance with one aspect of the present invention, a relatively small amount of $^{196}$Hg isotope for enrichment, preferably 1% or less, is employed. This is in comparison with the previous enrichment of this isotope of 3–5%. Because of the lesser amount of $^{196}$Hg isotope, there is thus a substantial cost saving because altering the natural isotopic composition via various enrichment schemes involves the costly handling and processing of large amounts of natural mercury. Thus, an improvement in efficiency of a fluorescent lamp comes about in a more inexpensive manner than by simply adding about 3–5% of $^{196}$Hg isotope.

The following chart gives the isotopic distribution for naturally occurring mercury.

| ISOTOPE (Mass Number) | Natural Abundance |
|---|---|
| 196 | 0.146% |
| 198 | 10.0% |
| 199 | 16.8% |
| 200 | 23.1% |
| 201 | 13.2% |
| 202 | 29.8% |
| 204 | 6.85% |

Two examples are now given of two different isotopic mixtures of mercury that have been studied. In the first case, the mercury is enriched with 1% of $^{196}$Hg isotope and then $\frac{1}{2}$ of $^{200}$Hg, $^{201}$Hg, and $^{202}$Hg isotopes along with $\frac{3}{4}$ of $^{204}Hg$ isotope are removed. This gives the following composition:

| ISOTOPE (Mass Number) | Isotope Percentage |
|---|---|
| 196 | 2.73% |
| 198 | 23.38% |
| 199 | 39.49% |
| 200 | 11.44% |
| 201 | 6.545% |
| 202 | 14.715% |
| 204 | 1.69% |

In the above mixture, the resonance trapping time is 0.900 times the trapping time of a natural mixture. In other words, there is a 10% improvement. This is only approximately 3.7% less than the improvement obtained by enriching the mixture with 3–5% $^{196}Hg$ isotope. On the other hand, the advantage of such an approach is that instead of processing about 20 to 30 times the amount of mercury needed (5%/0.146), there has to be processed only about 6 times (1%/0.146) the amount of mercury. There is also some additional processing in connection with the discard of about half of the high isotopes of $^{200}Hg$–$^{204}Hg$. Even so, there is only about 40% of the processing required in comparison to that required in providing the higher percentages or enrichment as in the past. Moreover, because half of the heavy isotopes are removed, the concepts of the invention are particularly useful for mass dependent mechanical separation methods such as diffusion, or the use of a calutron (mass spectrometric) or centrifuge. The aforementioned techniques are conventional existing technology.

The amount of processed material (mercury) may be reduced by another half so as to process approximately 6 times the amount of mercury needed. This may be carried out by enriching natural mercury with 0.5% $^{196}Hg$ isotope. Along with this enrichment, there is also provided for removal of the higher isotopes so that there exist only $\frac{1}{2}$ of isotopes $^{200}Hg$, $^{201}Hg$ and $^{202}Hg$ and removal of about $\frac{3}{4}$0 of isotope $^{204}Hg$. The resulting mixture has the following composition:

| ISOTOPE (Mass Number) | Isotope Percentage |
|---|---|
| 196 | 1.572% |
| 198 | 23.750% |
| 199 | 40.1% |
| 200 | 11.495% |
| 201 | 6.575% |
| 202 | 14.790% |
| 204 | 1.700% |

In the above mixture, the trapping time is reduced to 0.927 of the natural mixture for a gain of about 7.5%. Alternatively, if natural mercury is simply passed through a calutron or a gaseous diffusion set up (without any prior addition of $^{196}Hg$ isotope) and about $\frac{1}{2}$ of the $^{200}Hg$, $^{201}Hg$, $^{202}Hg$ and $^{204}Hg$ isotopes are removed, the improvement in resonant trapping time is about 2%. There is a similar improvement in removing about 30–50% of only $^{200}Hg$, $^{202}Hg$ and $^{204}Hg$ isotopes. It has been found that the improvement jumps substantially to about 8% by simply adding a relatively small percentage of $^{196}Hg$ isotope such as on the order of 1%. The aforementioned improvement to 8% has been accomplished by not only adding 1% of $^{196}Hg$ isotope, but also by removing about 30% of $^{200}Hg$ and $^{202}Hg$ isotopes.

In summary, there is improved efficiency that is comparable to the prior technique of adding 3–5% of a $^{196}Hg$ isotope, by providing $^{196}Hg$ isotope enrichment on the order of 1% or less combined with removal of some portion of the heavy isotopes of $^{200}Hg$ and above. In the preferred arrangement, there is provided for the enrichment of a natural isotopic mixture of mercury with less than 1% $^{196}Hg$ isotope and subsequent removal of about $\frac{1}{2}$ of the heavy isotopes ($^{200}Hg$–$^{204}Hg$) to reduce the trapping time of the mercury resonance radiation by as much as 10% and thus improve the efficiency of a fluorescent lamp by a similar order of magnitude. Furthermore, this is accomplished in a more economic fashion requiring less mercury processing.

While there have been shown are at present considered to be preferred embodiments of the invention, it will be apparent to those skilled in the art that various changes and modifications can be made herein without departing from the scope of the invention as defined by the appended claims.

I claim:

1. In a mercury-containing arc discharge device for converting electrical energy into resonance radiation, the $^{196}Hg$ isotope content of the mercury within the device being greater than that in natural mercury in order to increase the efficiency of converting said electrical energy into said resonance radiation but equal to or less than 1% enrichment of $^{196}Hg$, the heavy mercury isotopes of at least $^{200}Hg$, $^{201}Hg$ and $^{202}Hg$ having a content on the order of $\frac{1}{2}$ of natural mercury.

2. A device as set forth in claim 1 wherein the heavy mercury isotopes have a content on the order of $\frac{1}{2}$ of natural mercury.

3. A device as set forth in claim 1 wherein on the order of $\frac{3}{4}$ of $^{204}Hg$ isotope is removed from the mixture.

4. A device as set forth in claim 1 wherein the $^{196}Hg$ isotope enrichment is on the order of 0.5%.

5. A device as set forth in claim 1 wherein some portion of the following heavy mercury isotopes are removed: $^{200}Hg$, $^{201}Hg$, $^{202}Hg$, and $^{204}Hg$.

6. A device as set forth in claim 1 wherein the content of the heavy mercury isotopes is carried out by removal of about 30% of at least one of the heavy isotopes.

7. A device as set forth in claim 6 wherein about 30% of heavy isotopes $^{200}Hg$ and $^{202}Hg$ are removed.

8. A device as set forth in claim 1 wherein the resulting mercury mixture has the following composition:

| ISOTOPE (Mass Number) | Isotope Percentage |
|---|---|
| 196 | 2.73% |
| 198 | 23.38% |
| 199 | 39.49% |
| 200 | 11.44% |
| 201 | 6.545% |
| 202 | 14.715% |
| 204 | 1.69%. |

9. A device as set forth in claim 1 wherein the resulting mercury mixture has the following composition:

| ISOTOPE (Mass Number) | Isotope Percentage |
|---|---|
| 196 | 1.572% |
| 198 | 23.750% |
| 199 | 40.1% |
| 200 | 11.495% |
| 201 | 6.575% |
| 202 | 14.790% |
| 204 | 1.700%. |

* * * * *